US011866138B2

(12) United States Patent
Tanaka et al.

(10) Patent No.: US 11,866,138 B2
(45) Date of Patent: Jan. 9, 2024

(54) TRIM AND TILT DEVICE

(71) Applicant: Hitachi Astemo, Ltd., Hitachinaka (JP)

(72) Inventors: Nobuaki Tanaka, Hitachinaka (JP); Hayato Tsutsui, Hitachinaka (JP)

(73) Assignee: Hitachi Astero, Ltd., Hitachinaka (JP)

( * ) Notice: Subject to any disclaimer, the term of this patent is extended or adjusted under 35 U.S.C. 154(b) by 385 days.

(21) Appl. No.: 17/344,356

(22) Filed: Jun. 10, 2021

(65) Prior Publication Data

US 2022/0194537 A1 Jun. 23, 2022

(30) Foreign Application Priority Data

Dec. 18, 2020 (JP) ..... 2020-210040

(51) Int. Cl.
*B63H 20/10* (2006.01)
*B63H 20/06* (2006.01)

(52) U.S. Cl.
CPC ..... *B63H 20/10* (2013.01); *B63H 20/06* (2013.01)

(58) Field of Classification Search
CPC ..... B63H 20/10; B63H 20/06
See application file for complete search history.

(56) References Cited

U.S. PATENT DOCUMENTS 3,039,724 A * 6/1962 Herreman ..... B63H 20/10 248/642
2005/0170714 A1* 8/2005 Saito ..... B63H 20/10 440/61 T
2012/0073961 A1 3/2012 Kagawa
2014/0199898 A1* 7/2014 Takase ..... B63H 20/02 248/642
2017/0261015 A1* 9/2017 Tsutsui ..... B63H 20/10

FOREIGN PATENT DOCUMENTS

JP 2012-071683 A 4/2012

* cited by examiner

*Primary Examiner* — Stephen P Avila
(74) *Attorney, Agent, or Firm* — Leason Ellis LLP; Edward J. Ellis; Melvin C. Garner

(57) ABSTRACT

A trim and tilt device includes: a cylinder; a piston; a rod; and a rod guide. The rod includes a first end to which the piston is fixed, and the piston includes an insertion hole to which the first end of the rod is inserted. Over an entire periphery of the rod guide, a lower end of an outer peripheral surface of the rod guide that is in contact with the inner peripheral surface of the cylinder is located closer to a second end of the rod than a lower end of a first inner peripheral surface of the rod guide where the outer peripheral surface of the rod is slidable. An upper end of an outer peripheral surface of the piston is located closer to the second end of the rod than an upper end of the insertion hole.

18 Claims, 13 Drawing Sheets

TRIM AND TILT DEVICE

CROSS REFERENCE TO RELATED APPLICATIONS

This application claims the benefit of priority to Japanese Patent Application No. 2020-210040 filed on Dec. 18, 2020, the content of which is incorporated herein by reference in its entirety.

FIELD OF THE INVENTION

The present invention relates to a trim and tilt device that adjusts a tilt angle of a boat propulsion device.

BACKGROUND OF THE INVENTION

A small boat has a boat propulsion device (so-called outboard motor) that is a boat propulsion source. A stern bracket is fixed to a rear portion of the boat. A swivel bracket that can be tilted in an upper-lower direction is mounted to an upper portion of the stern bracket via a shaft member extending in a horizontal direction. When the boat propulsion device is mounted to the swivel bracket, a tilt angle of the boat propulsion device relative to the boat can be adjusted.

The tilt angle of the boat propulsion device can be adjusted by a trim and tilt device disposed between the stern bracket and the swivel bracket. JP 2012-71683 A discloses a technique related to the trim and tilt device.

The trim and tilt device disclosed in JP 2012-71683 A includes three hydraulic cylinder devices and a supply and discharge device that supplies hydraulic oil to and discharges hydraulic oil from the hydraulic cylinder devices. Each of the hydraulic cylinder devices includes a cylindrical cylinder, a piston provided inside a cylindrical body, a rod to which the piston is fixed at an end portion of the rod, and a rod guide that is fixed to an end portion of the cylindrical body and guides the rod to move forward and backward.

When the supply and discharge device supplies the hydraulic oil to an oil chamber in the cylinder, the piston in the cylinder moves in an axial direction and the rod moves forward and backward relative to the cylinder. When the rod moves forward and backward, the swivel bracket supported by the rod can be tilted, and a tilt angle of the boat propulsion device mounted to the swivel bracket can be adjusted.

As described above, the tilt angle of the boat propulsion device can be adjusted when the rod that supports the swivel bracket moves forward and backward. The own weights of the boat propulsion device and the swivel bracket and a thrust of the boat propulsion device are transmitted to the rod guide and the piston via the rod in the trim and tilt device.

When the outboard motor outputs a large thrust, a force applied to a sliding portion between the rod and the rod guide or a sliding portion between the piston and the cylinder is increased. When the outboard motor outputs a large thrust while maintaining a structure of the trim and tilt device in the related art, the force applied to the sliding portion is likely to be increased, and a force may be applied, for example, in a direction intersecting an axial direction of the rod. In such a case, the sliding portion is likely to be worn. It is effective to reduce a pressure applied to the sliding portion in order to prevent the wearing. Therefore, it is conceivable to increase a length of the sliding portion in the axial direction of the rod. However, when the length of the sliding portion is increased while preventing an increase in a size of the trim and tilt device, a movable range of the piston that moves forward and backward in the cylinder is shortened. As a result, it may be not possible to obtain a necessary outboard motor elevation angle.

SUMMARY OF THE INVENTION

An object of the present invention is to provide a trim and tilt device that can reduce wearing of a sliding portion without shortening a movable range of a piston that moves forward and backward in a cylinder.

As a result of diligent studies, the present inventor has found that when a length in an axial direction of a road is referred to as an axial length, wearing of a sliding portion between the rod and a rod guide can be reduced by making an axial length of an outer peripheral surface of the rod guide shorter than that in the related art and making an axial length of an inner peripheral surface of the rod guide longer than that in the related art. Further, the present inventor has found that wearing of the sliding portion between a piston and a cylinder can be reduced by making an axial length of an outer peripheral surface of the piston longer than that in the related art and making an axial length of an inner peripheral surface of the piston shorter than that in the related art. The present invention was completed based on these findings.

According to an aspect of the present invention, there is provided a trim and tilt device that includes: a bottomed cylindrical cylinder that stores a fluid; a piston that is slidable on an inner peripheral surface of the cylinder in an axial direction of the cylinder; a rod that is a rod-shaped member, the rod including a first end to which the piston is fixed and a second end located at an opposite side to the first end in the axial direction and located outside the cylinder; and a rod guide that is fixed to the cylinder and slidably supports an outer peripheral surface of the rod in the axial direction. Over an entire periphery of the rod guide, a lower end of a first outer peripheral surface of the rod guide that is in contact with the inner peripheral surface of the cylinder is located closer to the second end than a lower end of a first inner peripheral surface of the rod guide where the outer peripheral surface of the rod is slidable. The piston includes a second outer peripheral surface that is slidable on the inner peripheral surface of the cylinder and an insertion hole to which the first end of the rod is inserted. An upper end of the second outer peripheral surface is located closer to the second end than an upper end of the insertion hole.

DETAILED DESCRIPTION OF THE INVENTION

Figure 1:
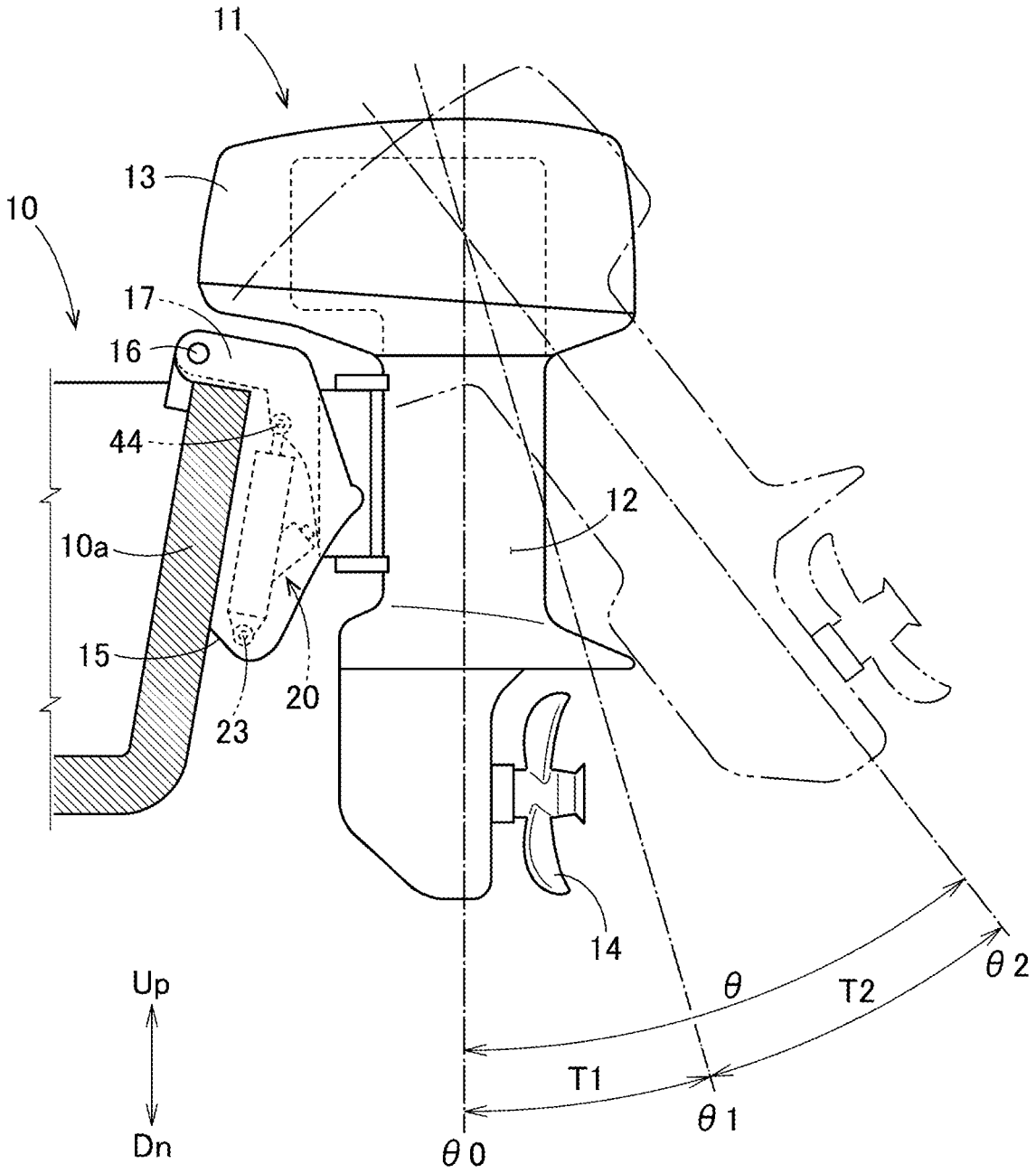
FIG. 1 is a side view showing a boat propulsion device provided with a trim and tilt device according to a first embodiment.

Embodiments of the present invention will be described below with reference to the accompanying drawings. Up indicates an upper direction and Dn indicates a lower direction in the drawings.

First Embodiment

FIG. 1 shows a boat propulsion device 11 (so-called outboard motor) that is mounted to a boat 10 and generates a propulsion for the boat 10. The boat propulsion device 11 includes a propulsion unit 12, an engine unit 13 provided at an upper portion of the propulsion unit 12, and a propeller 14 provided at a lower portion of the propulsion unit 12.

A stern bracket 15 is fixed to a rear plate 10*a* of the boat 10. A swivel bracket 17 that can be tilted around a shaft member 16 extending in a horizontal direction is mounted to an upper portion of the stern bracket 15. The propulsion unit 12 that can be tilted around a shaft member (not shown) extending in a vertical direction is mounted to the swivel bracket 17.

That is, the boat propulsion device 11 is mounted to the boat 10 in a manner in which the boat propulsion device 11 can be tilted around the shaft member 16. An angle at which the boat propulsion device 11 is tilted with reference to a predetermined direction (for example, the vertical direction) is defined as a tilt angle θ.

A region in which the tilt angle θ is within a range of θ0 to θ1 is referred to as a trim region T1. In the trim region T1, the tilt angle θ of the boat propulsion device 11 is adjusted in accordance with a posture of the boat 10, so that the propeller 14 is oriented in the horizontal direction relative to a water surface, and a thrust can be prevented from being reduced.

A region in which the tilt angle θ is within a range of θ1 to θ2 is referred to as a tilt region T2. In the tilt region T2, the boat propulsion device 11 can be lifted above the water surface by tilting the boat propulsion device 11 upward. Accordingly, it is possible to prevent corrosion or the like of the boat propulsion device 11 during mooring of the boat 10.

The tilt angle θ can be adjusted by a trim and tilt device 20 provided between the stern bracket 15 and the swivel bracket 17.

Figure 2:
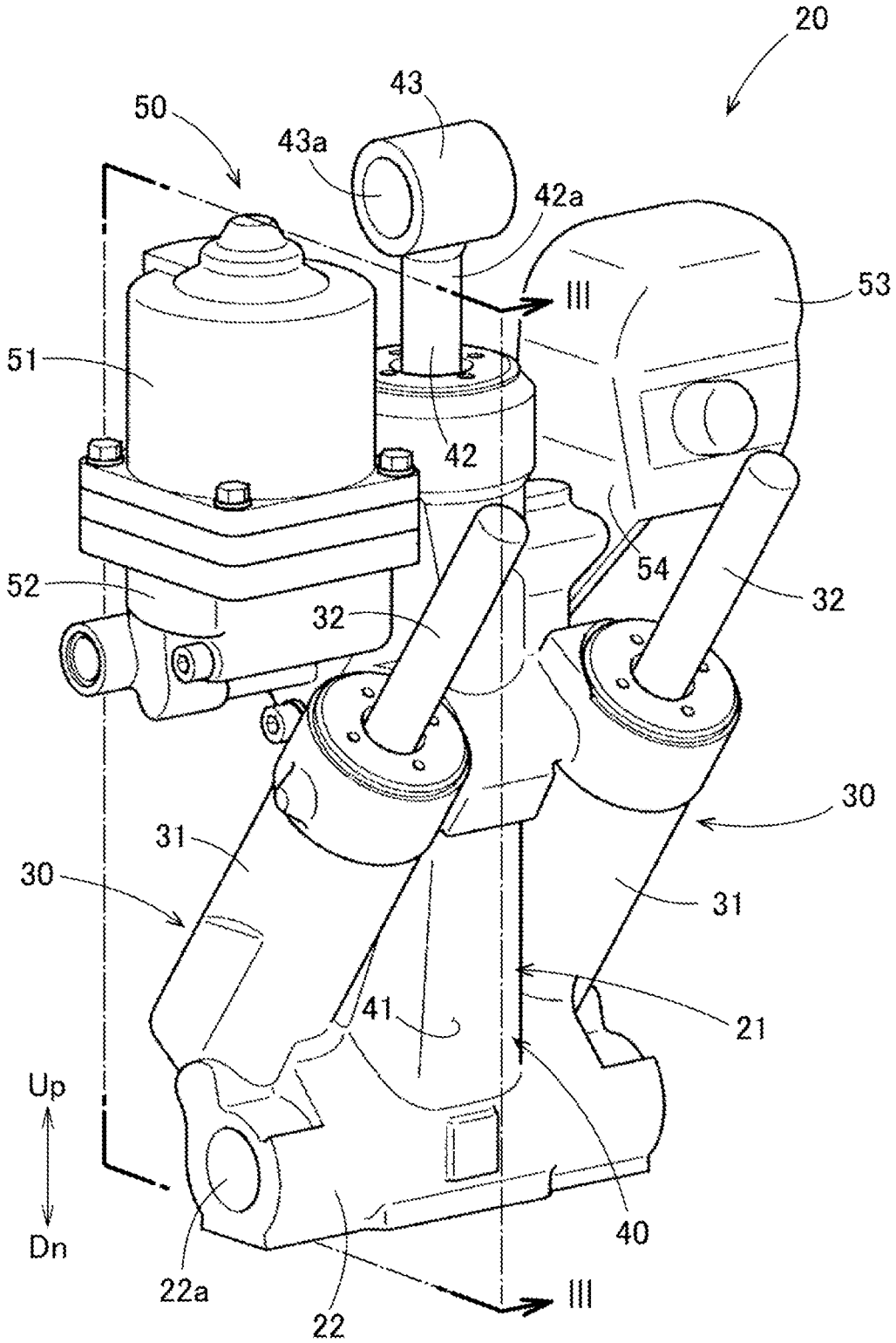
FIG. 2 is a perspective view showing the trim and tilt device shown in FIG. 1.

Description will be made with reference to FIG. 2. The trim and tilt device 20 includes three hydraulic cylinder devices 30, 30, and 40, and a supply and discharge device 50 that supplies hydraulic oil to and discharges hydraulic oil from the three hydraulic cylinder devices 30, 30, and 40. The hydraulic cylinder devices 30, 30, and 40 include a pair of trim cylinder devices 30 and 30, and a tilt cylinder device 40 provided between the pair of trim cylinder devices 30 and 30.

Each trim cylinder device 30 includes a bottomed cylindrical trim cylinder 31 that stores hydraulic oil serving as an example of a fluid, and a trim rod 32 that can move forward and backward relative to the trim cylinder 31. Hereinafter, an axial direction of the trim cylinder 31 may be simply referred to as an "axial direction".

The tilt cylinder device 40 includes a bottomed cylindrical tilt cylinder 41 that stores hydraulic oil serving as an example of a fluid, and a tilt rod 42 that can move forward and backward relative to the tilt cylinder 41. An upper end portion 42*a* of the tilt rod 42 is provided with a cylindrical first mounting portion 43 that can be mounted to the swivel bracket 17. The first mounting portion 43 has a first mounting hole 43*a* that passes through the first mounting portion 43 in a direction orthogonal to a direction in which the tilt rod 42 moves forward and backward. A first mounting pin 44 supported by the swivel bracket 17 can be inserted into the first mounting hole 43*a*.

The trim cylinder 31 and the tilt cylinder 41 are integrally formed with a housing 21 including an oil passage through which the hydraulic oil flows. Description of a hydraulic circuit including the oil passage in the housing 21 and the supply and discharge device 50 will be omitted.

The housing 21 includes a second mounting portion 22 that can mount the housing 21 to the stern brackets 15. The second mounting portion 22 has a second mounting hole 22*a* that passes through the second mounting portion 22 in the same direction as the first mounting hole 43*a*. A second mounting pin 23 supported by the stern bracket 15 can be inserted into the second mounting hole 22*a*.

The hydraulic oil supply and discharge device 50 includes a motor 51 that drives a pump for supplying and discharging the hydraulic oil, a motor support portion 52 that supports the motor 51, a tank 53 that stores the hydraulic oil supplied to and discharged from the pump, and a tank support portion 54 that supports the tank 53.

Figure 3:
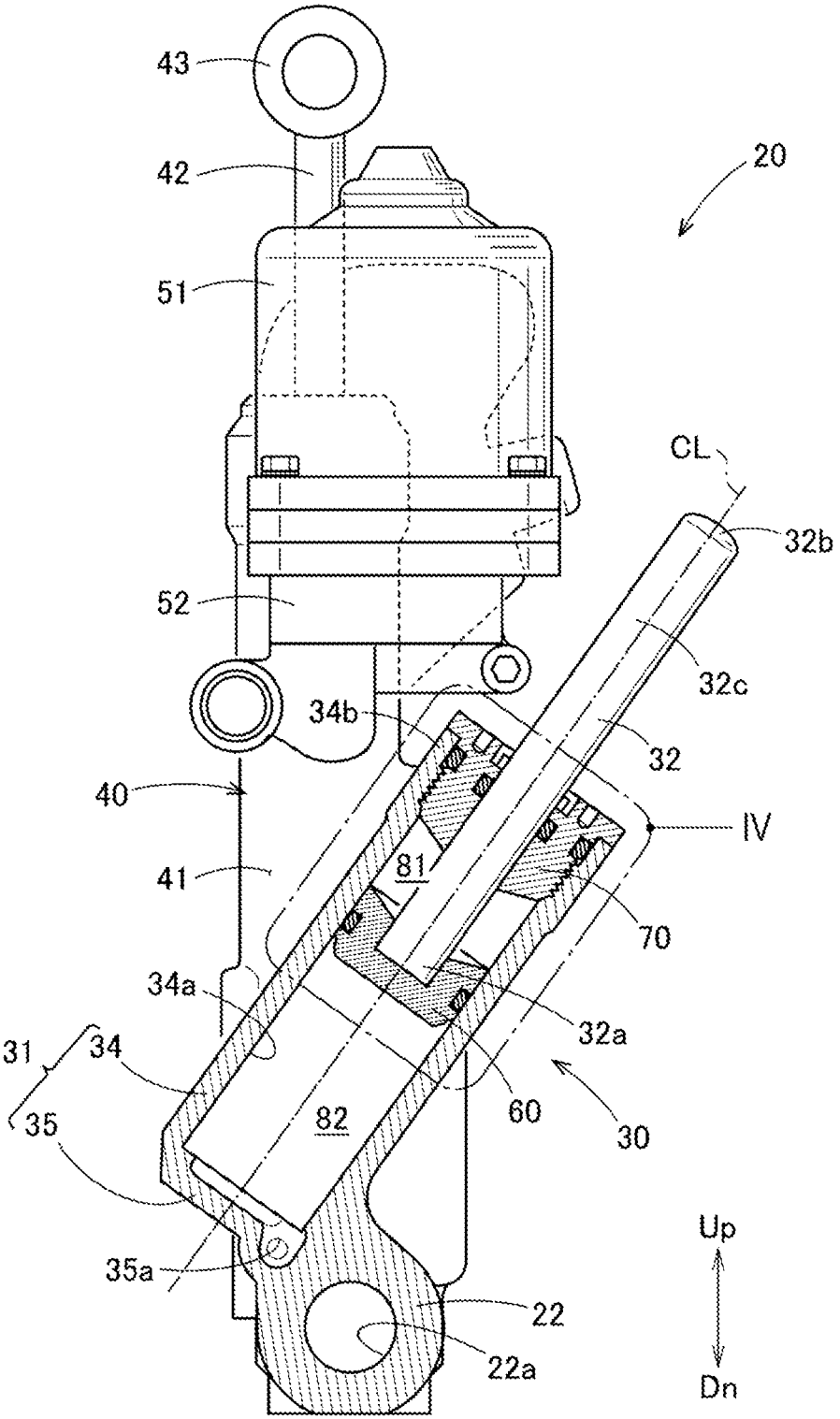
FIG. 3 is a cross-sectional view taken along line in FIG. 2.

Description will be made with reference to FIG. 3. The trim cylinder 31 is integrally formed with a cylindrical portion 34 having a cylindrical shape and a bottom portion 35 that closes a lower end of the cylindrical portion. A piston 60 that is slidable on an inner peripheral surface 34*a* of the cylindrical portion 34 in the axial direction (a direction in which an axis CL of the cylindrical portion 34 extends) is provided inside the cylindrical portion 34. The piston 60 divides an inner side of the cylindrical portion 34 into an oil chamber 81 at a rod guide 70 side and an oil chamber 82 at a bottom portion 35 side. The bottom portion 35 of the trim cylinder 31 has a communication hole 35*a* that communicates with the oil passage (not shown) formed in the housing 21.

The trim rod 32 is a rod-shaped member as a whole, and has a lower first end 32*a* to which the piston 60 is fixed, and an upper second end 32*b* located at an opposite side to the first end 32*a* in the axial direction. The second end 32*b* of the trim rod 32 is located outside the trim cylinder 31 and can come into contact with the swivel bracket 17.

The rod guide 70 that guides the trim rod 32 to move forward and backward is provided at an upper end portion 34*b* of the cylindrical portion 34 (an end at an opposite side to the bottom portion 35 in the axial direction). The rod guide 70 is screwed and fixed to the inner peripheral surface 34*a* of the cylindrical portion 34, and supports an outer peripheral surface 32*c* of the trim rod 32 in a manner in which the trim rod 32 can slide in the axial direction. Detailed description of the tilt cylinder device 40 will be omitted.

An operation of the trim and tilt device 20 in the trim region T1 will be described with reference to FIGS. 1 to 3. When the pump is rotated forward by rotating the motor 51 forward, oil discharged from the pump is supplied to the oil chamber 82 in the trim cylinder device 30, and the trim rod 32 withdraws from the trim cylinder 31. The second end 32*b* of the trim rod 32 that withdrew from the trim cylinder 31 comes into contact with the swivel bracket 17. Similarly, oil discharged from the pump is supplied to an oil chamber (not shown) at a lower side of the tilt cylinder 41, and the tilt rod 42 withdraws from the tilt cylinder 41. When the swivel bracket 17 is pushed up by the trim rod 32 and the tilt rod 42, the tilt angle θ of the boat propulsion device 11 is increased. When the pump is reversely rotated by reversely rotating the motor 51, the trim rod 32 enters the trim cylinder 31, and the tilt rod 42 enters the tilt cylinder 41, so that the swivel bracket 17 is lowered and the tilt angle θ of the boat propulsion device 11 is reduced.

An operation of the trim and tilt device 20 in the tilt region T2 will be described. After the tilt angle θ exceeds θ1, only the tilt rod 42 withdraws from the tilt cylinder 41 while the trim rod 32 remains in a state in which the trim rod 32 withdraws from the trim cylinder 31 to a largest extent. That is, only the tilt rod 42 pushes up the swivel bracket 17 so as to increase the tilt angle θ of the boat propulsion device 11. When the pump is reversely rotated by reversely rotating the motor 51, only the tilt rod 42 enters the tilt cylinder 41, and the tilt angle θ of the boat propulsion device 11 is reduced.

Description will be made with reference to FIGS. 4 and 5. The rod guide 70 has a small diameter portion 71 that is screwed and fixed to the inner peripheral surface 34*a* of the cylindrical portion 34, and a large diameter portion 72 of which a diameter is larger than a diameter of the small diameter portion 71, that is in contact with an upper end surface 34*c* of the cylindrical portion 34, and that regulates a movement of the rod guide 70 in the axial direction. The small diameter portion 71 and the large diameter portion 72 are formed integrally.

A first inner peripheral surface 73 of the rod guide 70 is a surface on which the outer peripheral surface 32*c* of the trim rod 32 slides. A first outer peripheral surface 74 of the rod guide 70 is a surface including an outer peripheral surface 71*a* of the small diameter portion 71 and an outer peripheral surface 72*a* of the large diameter portion 72.

Over the entire periphery of the rod guide 70, a length L1 in the axial direction of the first inner peripheral surface 73 of the rod guide 70 is longer than a length L2 in the axial direction of the first outer peripheral surface 74 of the rod guide 70. Each of the length L1 and the length L2 is a length starting from an upper end surface 72*b* (an end surface at a second end 32*b* (see FIG. 3) side of the rod guide 70) of the large diameter portion 72. The upper end surface 72*b* of the large diameter portion 72 is a flat surface that extends in a radial direction of the cylindrical portion 34 (the axial direction is a normal direction).

A lower end surface of the small diameter portion 71 (an end surface of the rod guide 70 facing toward a first end 32*a*) is a first end surface 75 having an annular shape. In a cross section including an axis CL, the first end surface 75 is tilted relative to a radial direction of the cylindrical portion 34 and the trim cylinder 31, and an angle (tilt angle) formed by the radial direction and the first end surface 75 is θ1. The first end surface 75 is a surface that is tilted in a manner of coming close to the piston 60 as going inward in a radial direction of the first end surface 75, and is a surface that is convex toward the first end 32*a* side.

The first outer peripheral surface 74 has a first outer peripheral edge 74*a* connected (continuous) to the first end surface 75. The first inner peripheral surface 73 has a first inner peripheral edge 73*a* connected to the first end surface 75. The first inner peripheral edge 73*a* is located closer to the piston 60 than the first outer peripheral edge 74*a*.

A seal member 87 that prevents a liquid from entering the trim cylinder 31 is provided on the upper end surface 72*b* of the large diameter portion 72. The first inner peripheral surface 73 has a groove for disposing a seal member 88 that seals a gap between the first inner peripheral surface 73 and the outer peripheral surface 32*c* of the trim rod 32. The outer peripheral surface 71*a* of the small diameter portion 71 has a groove for disposing a seal member 89 that seals a gap between the outer peripheral surface 71*a* of the small diameter portion 71 and the inner peripheral surface 34*a* of the cylindrical portion 34.

The piston 60 includes a second outer peripheral surface 61 that is slidable on the inner peripheral surface 34*a* of the cylindrical portion 34, an insertion hole 62 into which the first end 32*a* of the trim rod 32 is inserted, and an end surface 63 at an opposite side to the rod guide 70 side. The end surface 63 is a flat surface extending in the radial direction of the cylindrical portion 34. A through hole may be adopted instead of the insertion hole 62.

Over the entire periphery of the piston 60, an outer peripheral end 61*a* of the second outer peripheral surface 61 of the piston 60, which is an end close to the second end 32*b* of the trim rod 32, is closer to the second end 32*b* than an insertion end 62*a* of the insertion hole 62, which is an end close to the second end 32*b*.

The piston 60 has a second end surface 64 that is an end surface facing toward the rod guide 70 and has an annular shape. In a cross section including the axis CL of the trim cylinder 31, the second end surface 64 is tilted relative to a radial direction of the trim cylinder 31 and the cylindrical portion 34, and an angle (tilt angle) formed between the radial direction and the second end surface 64 is θ2. The second end surface 64 is a surface that is tilted in a manner of coming close to the rod guide 70 as going outward in a radial direction of the second end surface 64, and is a surface that is convex toward the first end 32*a* side.

The insertion end 62*a* that is a peripheral edge of the insertion hole 62 is connected to the second end surface 64. The second outer peripheral surface 61 has the outer peripheral end 61*a* connected to the second end surface 64. The outer peripheral end 61*a* is located closer to the rod guide 70 than the insertion end 62*a*.

In the trim and tilt device 20, θ1=θ2. The second outer peripheral surface 61 has a groove for disposing a seal member 86 that seals a gap between the second outer peripheral surface 61 and the inner peripheral surface 34*a* of the cylindrical portion 34.

Effects of the first embodiment will be described.

Description will be made with reference to FIGS. 4 and 5. In the trim cylinder device 30, over the entire periphery of the rod guide 70, a length L1 in the axial direction of the first inner peripheral surface 73 of the rod guide 70 on which the outer peripheral surface 32*c* of the trim rod 32 can slide is longer than a length L2 in the axial direction of the first outer peripheral surface 74 of the rod guide 70 that is in contact with the inner peripheral surface 34*a* of the cylindrical portion 34.

The first inner peripheral surface 73 of the rod guide 70 is a surface that slidably supports the trim rod 32. The rod guide 70 has a larger surface that slidably supports the trim rod 32 than a rod guide in the related art that has a length in the axial direction of the outer peripheral surface the same as a length in the axial direction of the inner peripheral surface. Therefore, even when a force is applied in a direction intersecting the axial direction of the trim rod 32, a pressure applied to the first inner peripheral surface 73 can be reduced as compared with the rod guide in the related art. Therefore, wearing of the outer peripheral surface 32*c* of the trim rod 32 and the first inner peripheral surface 73 of the rod guide 70 can be reduced.

In addition, in the trim cylinder device 30, over the entire periphery of the piston 60, the outer peripheral end 61*a* of the second outer peripheral surface 61 of the piston 60, which is an end close to the second end 32*b*, is closer to the second end 32*b* than the insertion end 62*a* of the insertion hole 62, which is an end close to the second end 32*b*.

The second outer peripheral surface 61 of the piston 60 is a surface that slides on the inner peripheral surface 34*a* of the cylindrical portion 34. The piston 60 has a larger second outer peripheral surface 61 that slides on the inner peripheral surface 34*a* of the cylindrical portion 34 than a piston in the related art of which the outer peripheral end and the insertion end are located at the same level in the axial direction. Therefore, even when a force is applied in a direction intersecting the axial direction of the trim rod 32, a pressure applied to the piston 60 and the cylindrical portion 34 can be reduced as compared with the piston in the related art. Therefore, wearing of the inner peripheral surface 34*a* of the trim rod 34 and the second outer peripheral surface 61 of the piston 60 can be reduced.

The small diameter portion 71 of the rod guide 70 has the first end surface 75 that is an end surface facing toward the first end 32*a* of the trim rod 32 and has an annular shape. In a cross section including the axis CL of the cylindrical portion 34, the first end surface 75 is tilted relative to the radial direction of the cylindrical portion 34, and an angle (tilt angle) formed between the radial direction and the first end surface 75 is θ1. The first end surface 75 is tilted in a manner of coming close to the piston 60 as going inward in the radial direction of the first end surface 75.

The piston 60 has the second end surface 64 that is an end surface facing toward the rod guide 70 and has an annular shape. In a cross section including the axis CL of the trim cylinder 31, the second end surface 64 is tilted relative to the radial direction of the cylindrical portion 34, and an angle (tilt angle) formed between the radial direction and the second end surface 64 is θ2. The second end surface 64 is tilted in a manner of coming close to the rod guide 70 as going outward in a radial direction of the second end surface 64. The tilt angle θ1 of the first end surface 75 and the tilt angle θ2 of the second end surface 64 are equal to each other.

Figure 6:
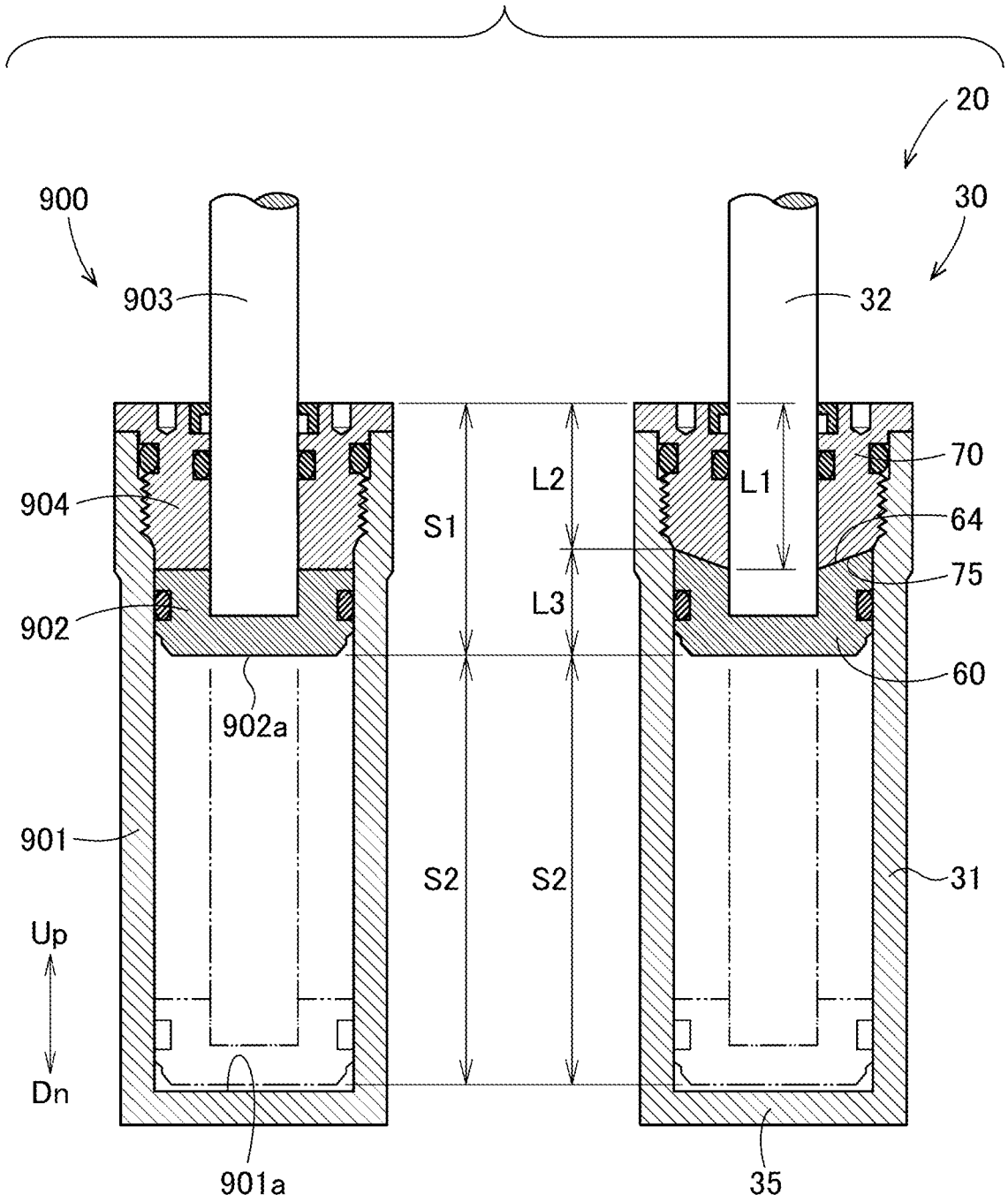
FIG. 6 is a view showing a comparison between a trim and tilt device in the related art and the trim and tilt device according to the first embodiment.

A trim cylinder device 900 in the related art is shown at a left side in FIG. 6. The trim cylinder device 900 includes a cylindrical trim cylinder 901, a piston 902 that slides on an inner peripheral surface of the trim cylinder 901 in the axial direction, a rod 903 to which the piston 902 is fixed to a lower end portion of the rod 903, and a rod guide 904 that is fixed to the trim cylinder 901 and slidably supports the rod 903. In a state in which the rod 903 withdraws from the trim cylinder 901 to a largest extent, a distance between a lower end surface 902*a* of the piston 902 and an upper end surface of the rod guide 904 is S1, and a length from a bottom surface 901*a* of the trim cylinder 901 to the lower end surface 902*a* of the piston 902 (stroke length) is S2.

The trim cylinder device 30 provided in the trim and tilt device 20 according to the first embodiment is shown at a right side in FIG. 6. As shown in FIG. 4, the tilt angle θ1 of the first end surface 75 and the tilt angle θ2 of the second end surface 64 are equal to each other. The first end surface 75 and the second end surface 64 can come into contact with each other over the entire periphery.

Description will be made with reference to FIG. 4. A sum of the length L2 of the first outer peripheral surface 74 of the rod guide 70 and a length L3 of the second outer peripheral surface 61 of the piston 60 is equal to the length S1. Therefore, a stroke length of the trim cylinder device 30 is also S2. According to the trim and tilt device 20, wearing of a sliding portion can be reduced while the stroke length S2 the same as that of the trim cylinder device 900 can be maintained.

Description will be made with reference to FIG. 4. As long as the first inner peripheral edge 73*a* of the rod guide is located closer to the piston 60 than the first outer peripheral edge 74*a*, the first end surface 75 according to the first embodiment is not limited to a tilted surface. Similarly, as long as the outer peripheral end 61*a* of the piston 60 is located closer to the rod guide 70 than the insertion end 62*a*, the second end surface 64 according to the first embodiment is not limited to a tilted surface. Hereinafter, another configuration of the first end surface 75 and the second end surface 64 will be described.

Figure 7:
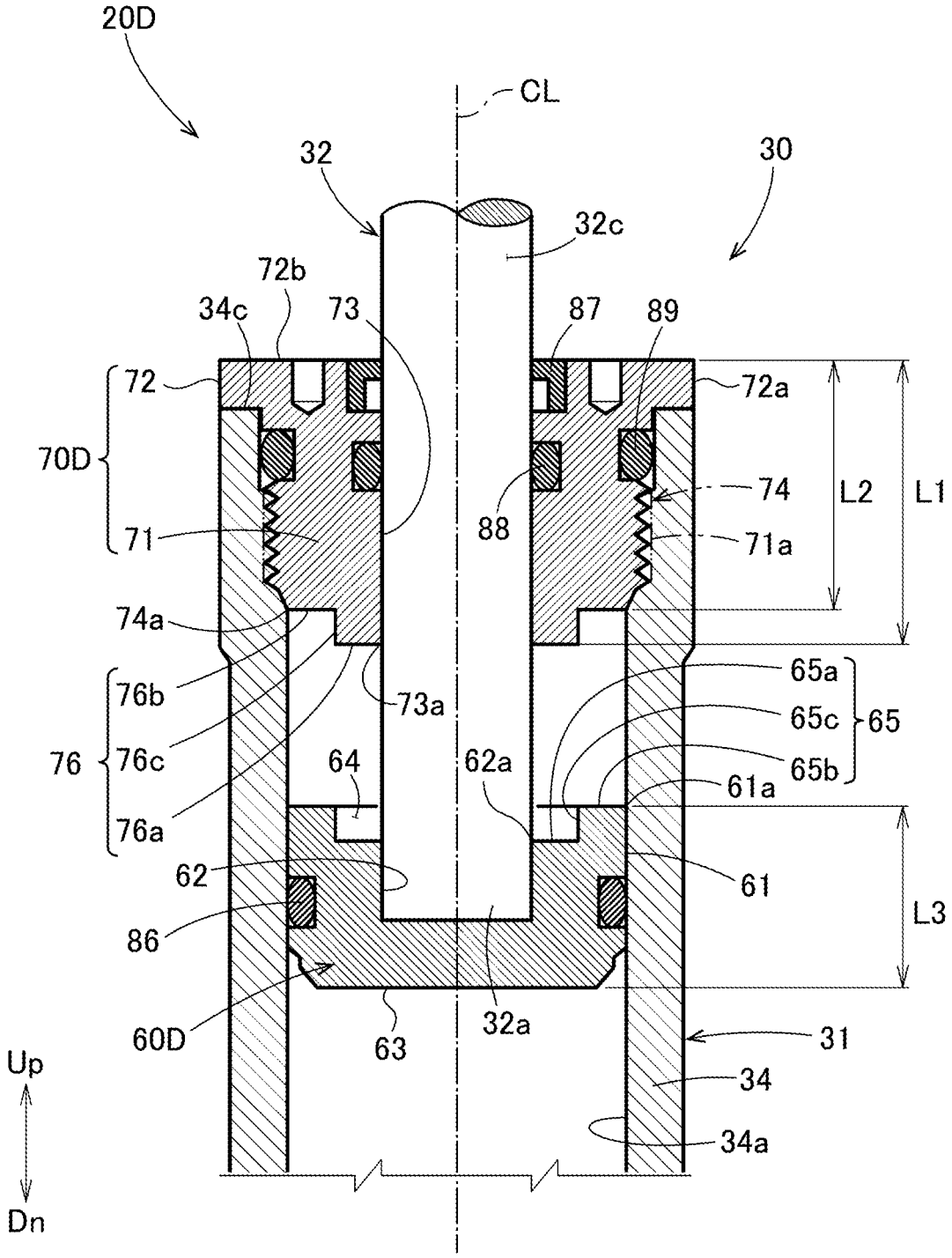
FIG. 7 is a view showing an example of the trim and tilt device according to the first embodiment.

FIG. 7 shows a trim and tilt device 20D according to the first embodiment. Components the same as those of the trim and tilt device 20 (see FIG. 4) according to the first embodiment will be denoted by the same reference numerals.

The trim and tilt device 20D includes the cylindrical trim cylinder 31, a piston 60D that slides in the trim cylinder 31, the trim rod 32 to which the piston 60D is fixed at the first end portion 32*a*, and a rod guide 70D that is screwed and fixed to the trim cylinder 31 and slidably supports the trim rod 32.

In a cross section including the axis CL, a first end surface 76 of the rod guide 70D has, for example, a stepped shape. Specifically, the first end surface 76 has a first inner peripheral portion 76*a* that is connected to the first inner peripheral edge 73*a* and faces the axial direction (the axial direction is a normal direction), a first outer peripheral portion 76*b* that is connected to the first outer peripheral edge 74*a* and faces the axial direction, and a first side surface portion 76*c* that connects the first inner peripheral portion 76*a* and the first outer peripheral portion 76*b* and corresponds to an outer peripheral surface of a cylindrical shape.

In a cross section including the axis CL, a second end surface 65 of the piston 60D has, for example, a stepped shape. Specifically, the second end surface 65 includes a second inner peripheral portion 65*a* that is connected to the insertion end 62*a* and can be in surface contact with the first inner peripheral portion 76*a*, a second outer peripheral portion 65*b* that is connected to the outer peripheral end 61*a* and can be in surface contact with the first outer peripheral portion 76*b*, and a second side surface portion 65*c* that connects the second inner peripheral portion 65*a* and the second outer peripheral portion 65*b* and can be in surface contact with the first side surface portion 76*c*.

Figure 8:
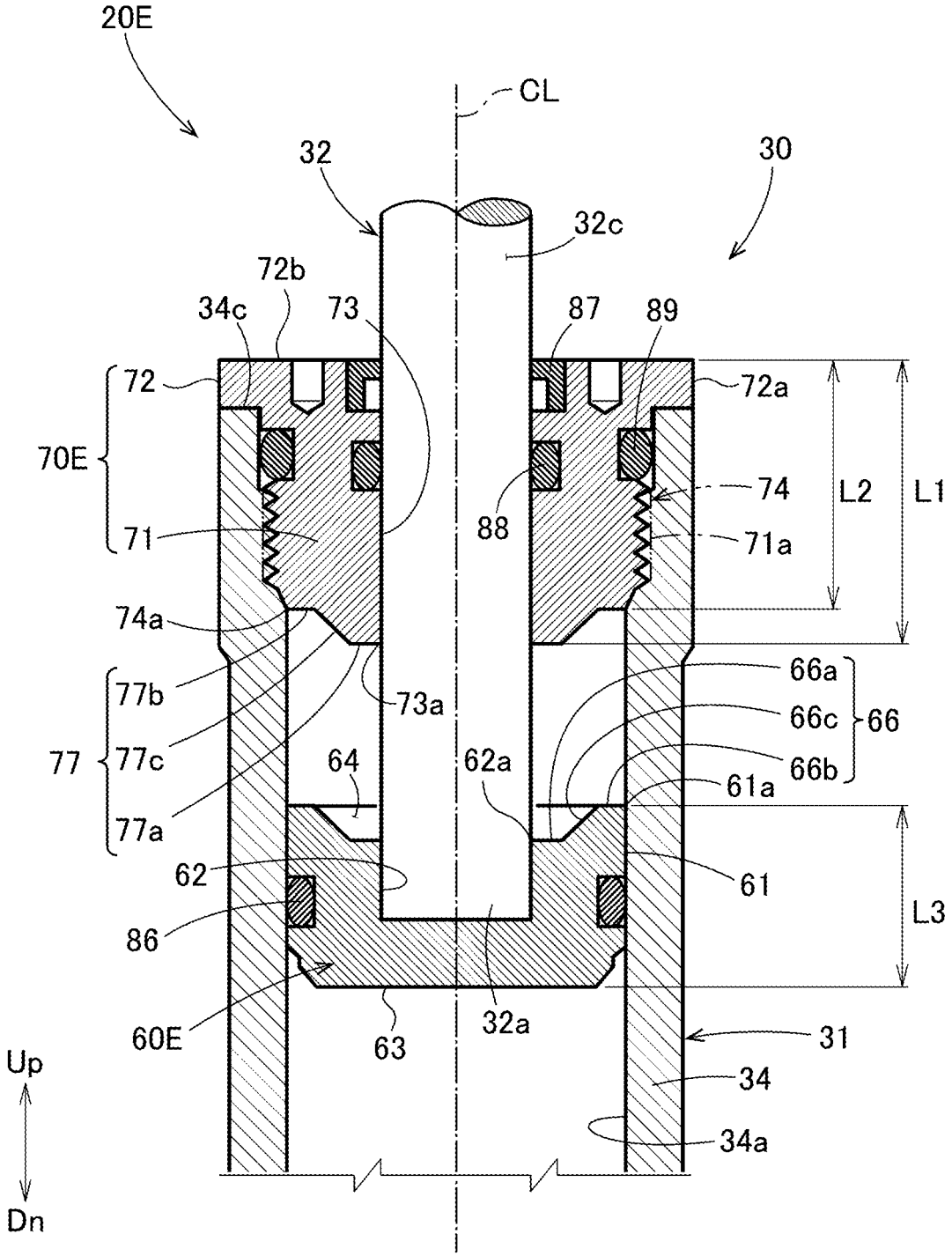
FIG. 8 is a view showing an example of the trim and tilt device according to the first embodiment.

FIG. 8 shows a trim and tilt device 20E according to the first embodiment. Components the same as those of the trim and tilt device 20 (see FIG. 4) according to the first embodiment will be denoted by the same reference numerals.

The trim and tilt device 20E includes the cylindrical trim cylinder 31, a piston 60E that slides in the trim cylinder 31, the trim rod 32 to which the piston 60E is fixed at the first end portion 32*a*, and a rod guide 70E that is screwed and fixed to the trim cylinder 31 and slidably support the trim rod 32.

In a cross section including the axis CL, a first end surface 77 of the rod guide 70E has, for example, a stepped shape. Specifically, the first end surface 77 includes a first inner peripheral portion 77*a* that is connected to the first inner peripheral edge 73*a* and faces the axial direction, a first outer peripheral portion 77*b* that is connected to the first outer peripheral edge 74*a* and faces the axial direction, and a first side surface portion 77*c* that connects the first inner peripheral portion 77*a* and the first outer peripheral portion 77*b* and corresponds to a side surface of the truncated cone shape.

In a cross section including the axis CL, a second end surface 66 of the piston 60E has, for example, a stepped shape. Specifically, the second end surface 66 includes a second inner peripheral portion 66*a* that is connected to the insertion end 62*a* and can be in surface contact with the first inner peripheral portion 77*a*, a second outer peripheral portion 66*b* that is connected to the outer peripheral end 61*a* and can be in surface contact with the first outer peripheral portion 77*b*, and a second side surface portion 66*c* that connects the second inner peripheral portion 66*a* and the second outer peripheral portion 66*b* and can be in surface contact with the first side surface portion 77*c*.

Second Embodiment

Figure 9:
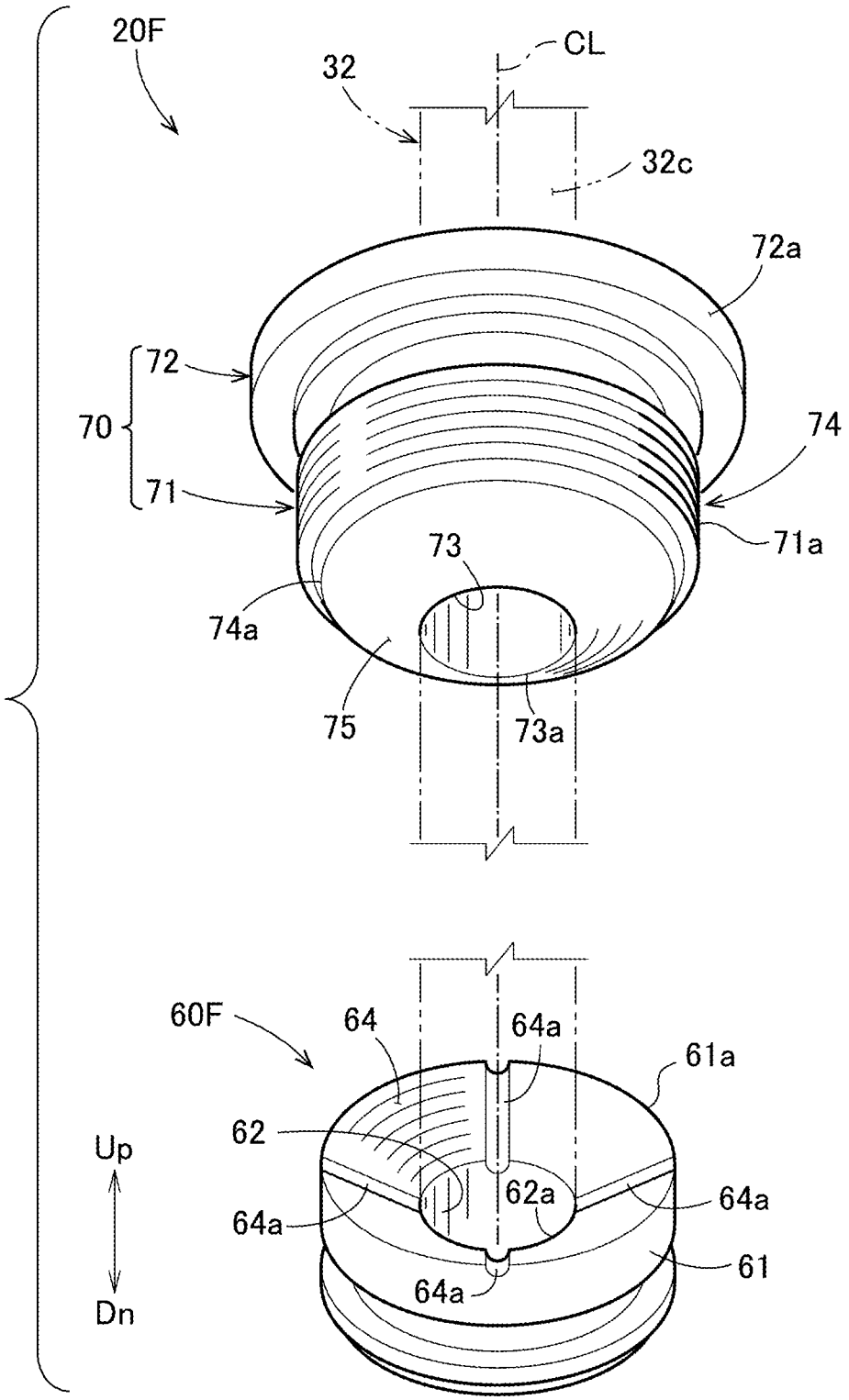
FIG. 9 is a perspective view showing a rod guide and a piston that are provided in a trim and tilt device according to a second embodiment.

FIG. 9 shows a trim and tilt device 20F according to a second embodiment. Components the same as those of the trim and tilt device 20 (see FIG. 4) according to the first embodiment will be denoted by the same reference numerals.

In the trim and tilt device 20F, the second end surface 64 of a piston 60F has a plurality of (for example, four) grooves 64*a*. The plurality of grooves 64*a* extend radially from the insertion end 62*a* of the piston 60F to the outer peripheral end 61*a*. The plurality of grooves 64*a* are located at equal intervals in a peripheral direction of the second end surface 64. The number of the grooves 64*a* and positions of the grooves 64*a* in the peripheral direction may be changed as appropriate.

Effects of the second embodiment will be described.

A case will be described in which the piston 60F is operated toward the bottom portion 35 of the trim cylinder 31 from a state in which the second end surface 64 of the piston 60F is brought into close contact with the first end surface 75 of the rod guide 70.

As described above, the second end surface 64 of the piston 60F has four grooves 64*a*. Therefore, even when the second end surface 64 is brought into close contact with the first end surface 75, gaps are generated between the grooves 64*a* of the piston 60F and the first end surface 75 of the rod guide 70. Hydraulic oil is introduced into the gaps. Since the second end surface 64 of the piston 60F has the grooves 64*a* that allows a movement of the hydraulic oil, the hydraulic oil easily flows between the second end surface 64 and the first end surface 75. As a result, the piston 60F is easily separated from the rod guide 70, so that the piston can be smoothly moved.

In addition, the grooves 64*a* are formed from the insertion end 62*a* of the piston 60F to the outer peripheral end 61*a*. The outer peripheral end 61*a* serves as an introduction port of the hydraulic oil, and the hydraulic oil is easily introduced into the grooves 64*a* (gaps).

The effects described above can also be obtained by the trim and tilt devices 20G to 20J according to the second embodiment to be described below.

Figure 10:
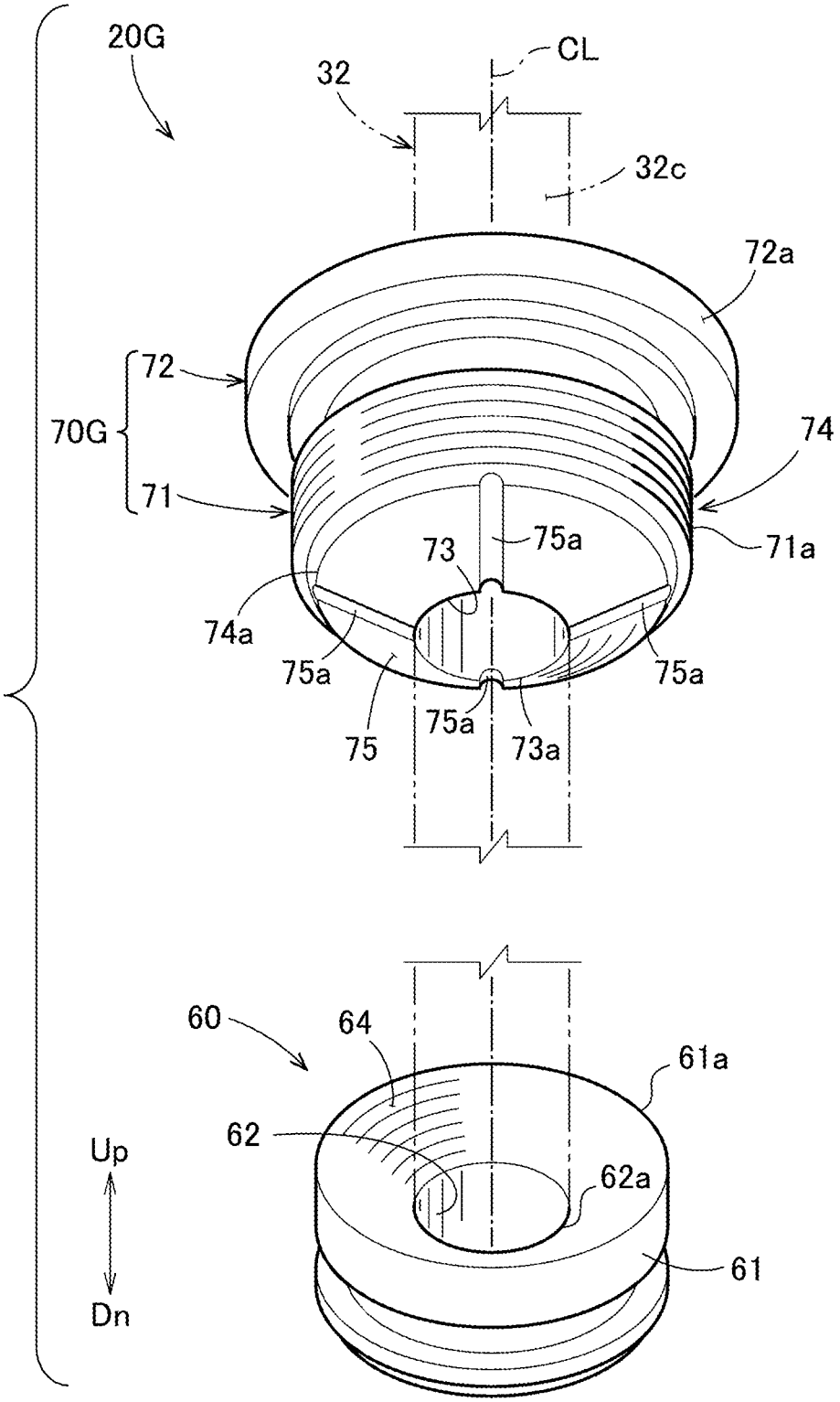
FIG. 10 is a perspective view showing an example of the rod guide and the piston that are provided in the trim and tilt device according to the second embodiment.

FIG. 10 shows a trim and tilt device 20G according to the second embodiment. Components the same as those of the trim and tilt device 20 (see FIG. 5) according to the first embodiment will be denoted by the same reference numerals.

In the trim and tilt device 20G, the first end surface 75 of a rod guide 70G has a plurality of (for example, four) grooves 75*a*. The plurality of grooves 75*a* extend radially from the first inner peripheral edge 73*a* of the rod guide 70G to the first outer peripheral edge 71*a*. The plurality of grooves 75*a* are located at equal intervals in a peripheral direction of the first end surface 75. The number of the grooves 75*a* and positions of the grooves 75*a* in the peripheral direction may be changed as appropriate.

Figure 11:
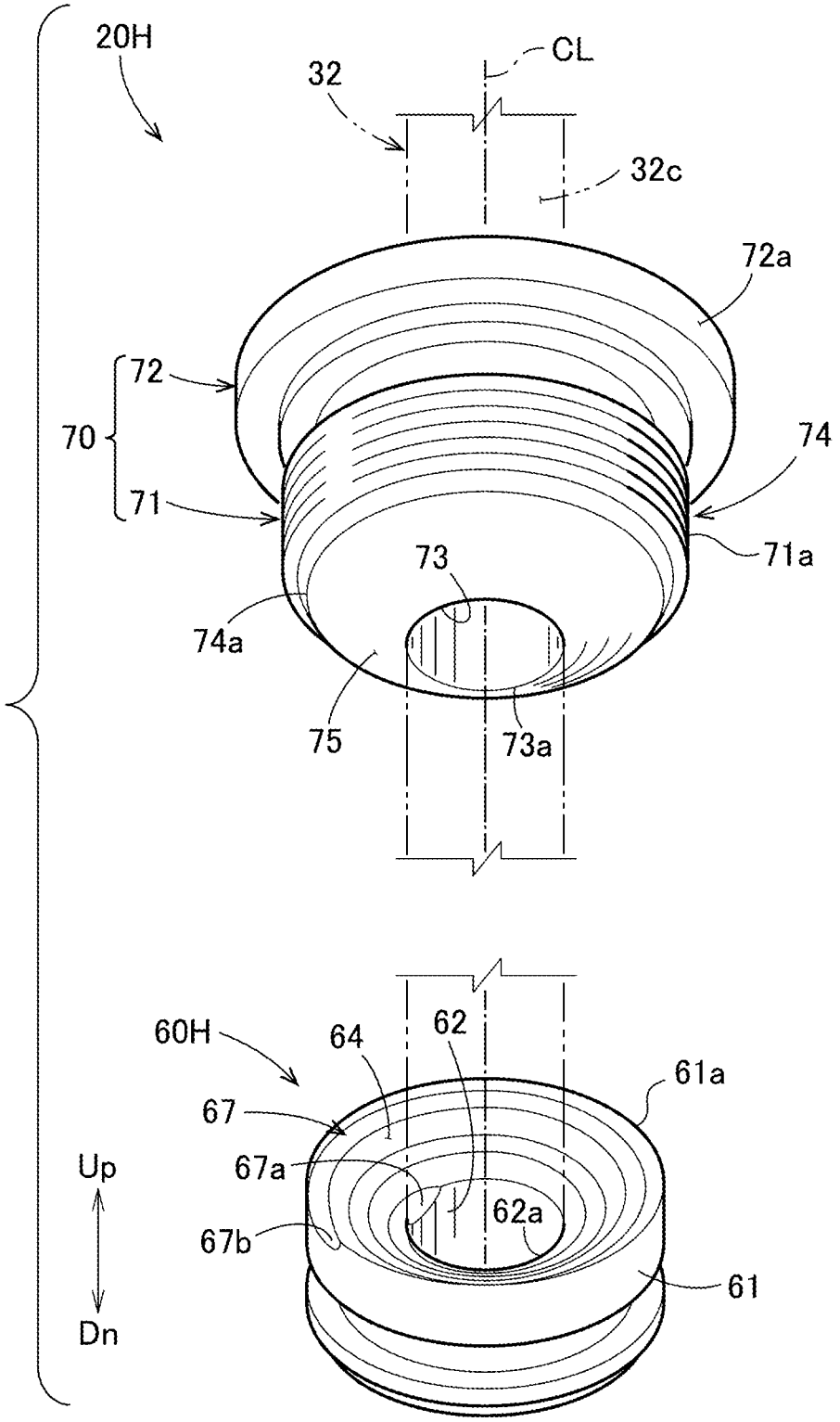
FIG. 11 is a perspective view showing an example of the rod guide and the piston that are provided in the trim and tilt device according to the second embodiment.

FIG. 11 shows a trim and tilt device 20H according to the second embodiment. Components the same as those of the trim and tilt device 20 (see FIG. 5) according to the first embodiment will be denoted by the same reference numerals.

The second end surface 64 of a piston 60H has a spiral groove 67 having a spiral shape centered on the axis CL in the trim and tilt device 20H. An end portion 67*a* of the spiral groove 67 at an innermost side in the radial direction is connected to the insertion end 62*a*. An end portion 67*b* of the spiral groove 67 at an outermost side in the radial direction is connected to the outer peripheral end 61*a*. A spiral winding direction (clockwise and counterclockwise), the number of turns, a width, and a length of the spiral groove 67 can be set as appropriate.

Figure 12:
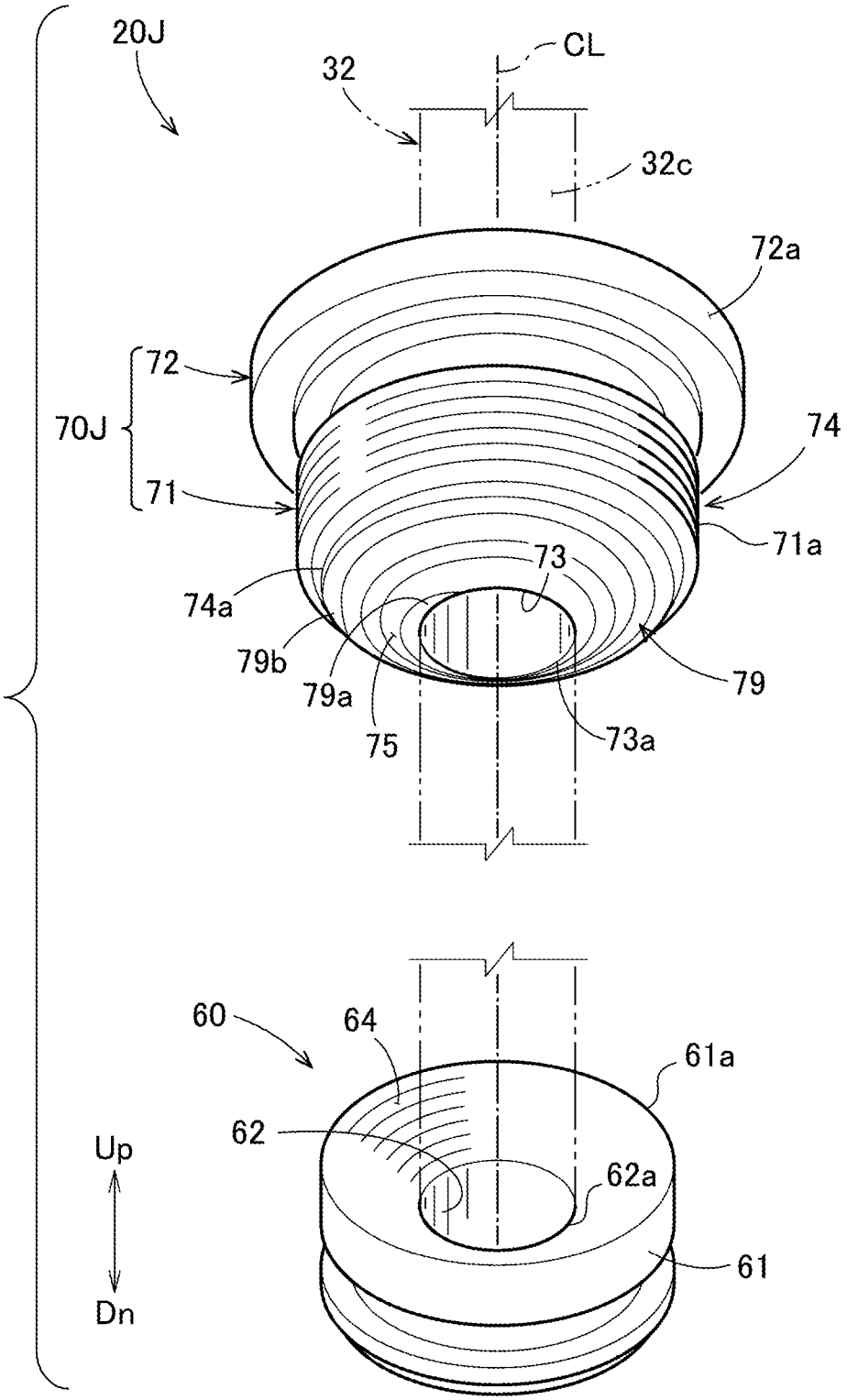
FIG. 12 is a perspective view showing an example of the rod guide and the piston that are provided in the trim and tilt device according to the second embodiment.

FIG. 12 shows a trim and tilt device 20J according to the second embodiment. Components the same as those of the trim and tilt device 20 (see FIG. 5) according to the first embodiment will be denoted by the same reference numerals.

In the trim and tilt device 20J, the first end surface 75 of a rod guide 70J has a spiral groove 79 having a spiral shape centered on the axis CL. An end portion 79*a* of the spiral groove 79 at an innermost side in the radial direction is connected to the first inner peripheral edge 73*a*. An end portion 79*b* of the spiral groove 79 at an outermost side in the radial direction is connected to the first outer peripheral edge 71*a*. A spiral winding direction (clockwise and counterclockwise), the number of turns, a width, and a length of a groove of the spiral groove 79 can be set as appropriate.

Figure 13:
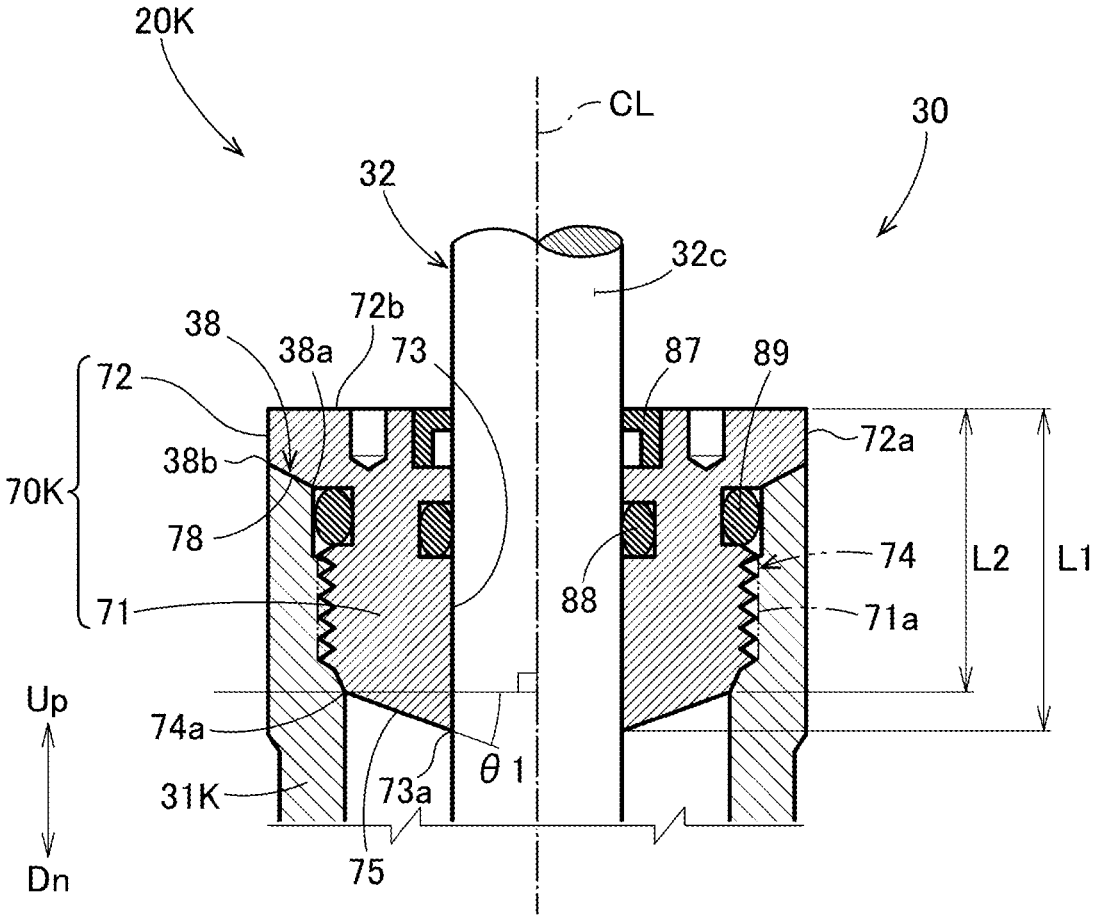
FIG. 13 is a cross-sectional view showing a rod guide and a piston that are provided in a trim and tilt device according to a third embodiment.

FIG. 13 shows a trim and tilt device 20K according to a third embodiment. Components the same as those of the trim and tilt device 20 (see FIG. 4) according to the first embodiment will be denoted by the same reference numerals.

Figure 4:
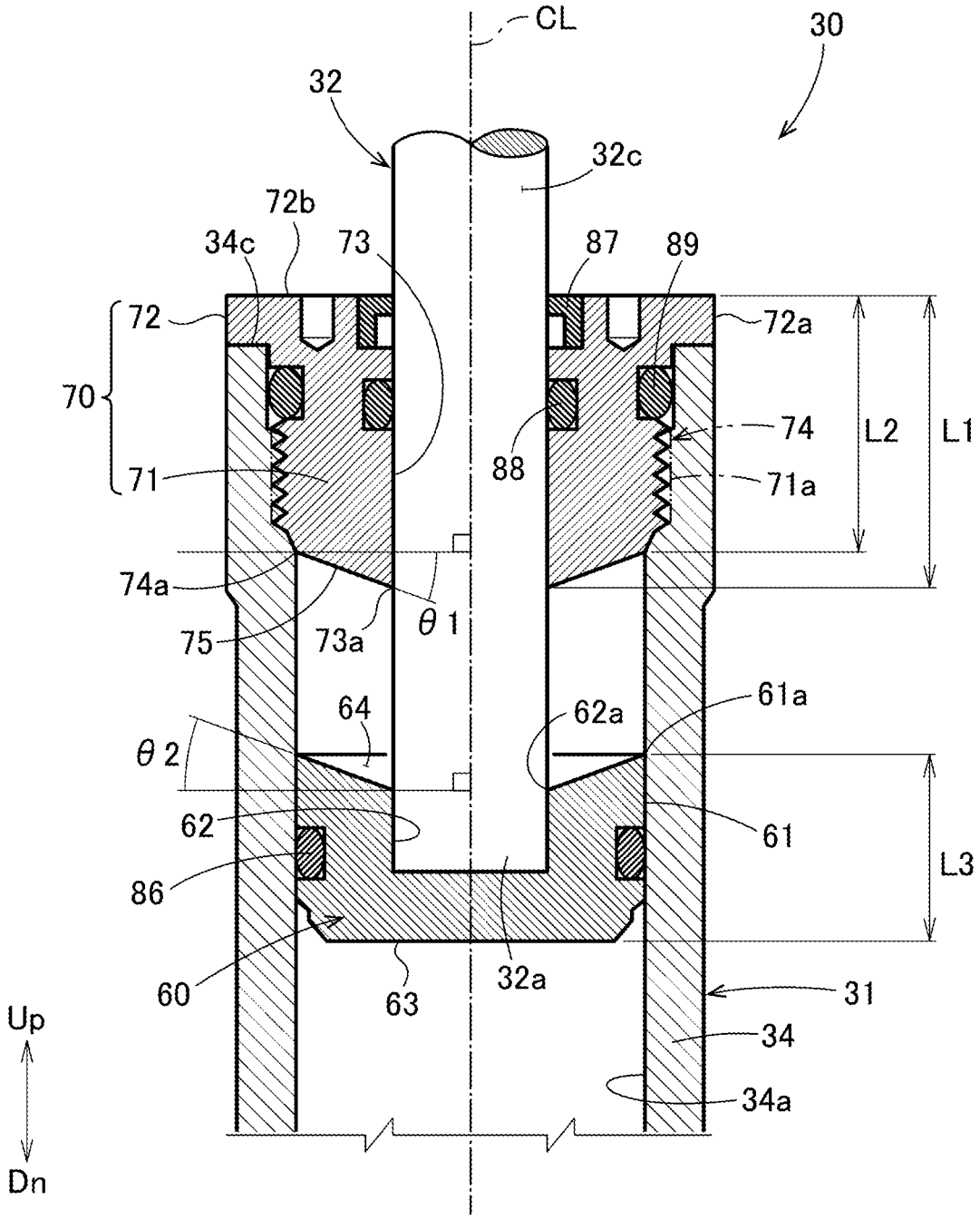
FIG. 4 is an enlarged view showing a portion denoted by IV in FIG. 3.
Figure 5:
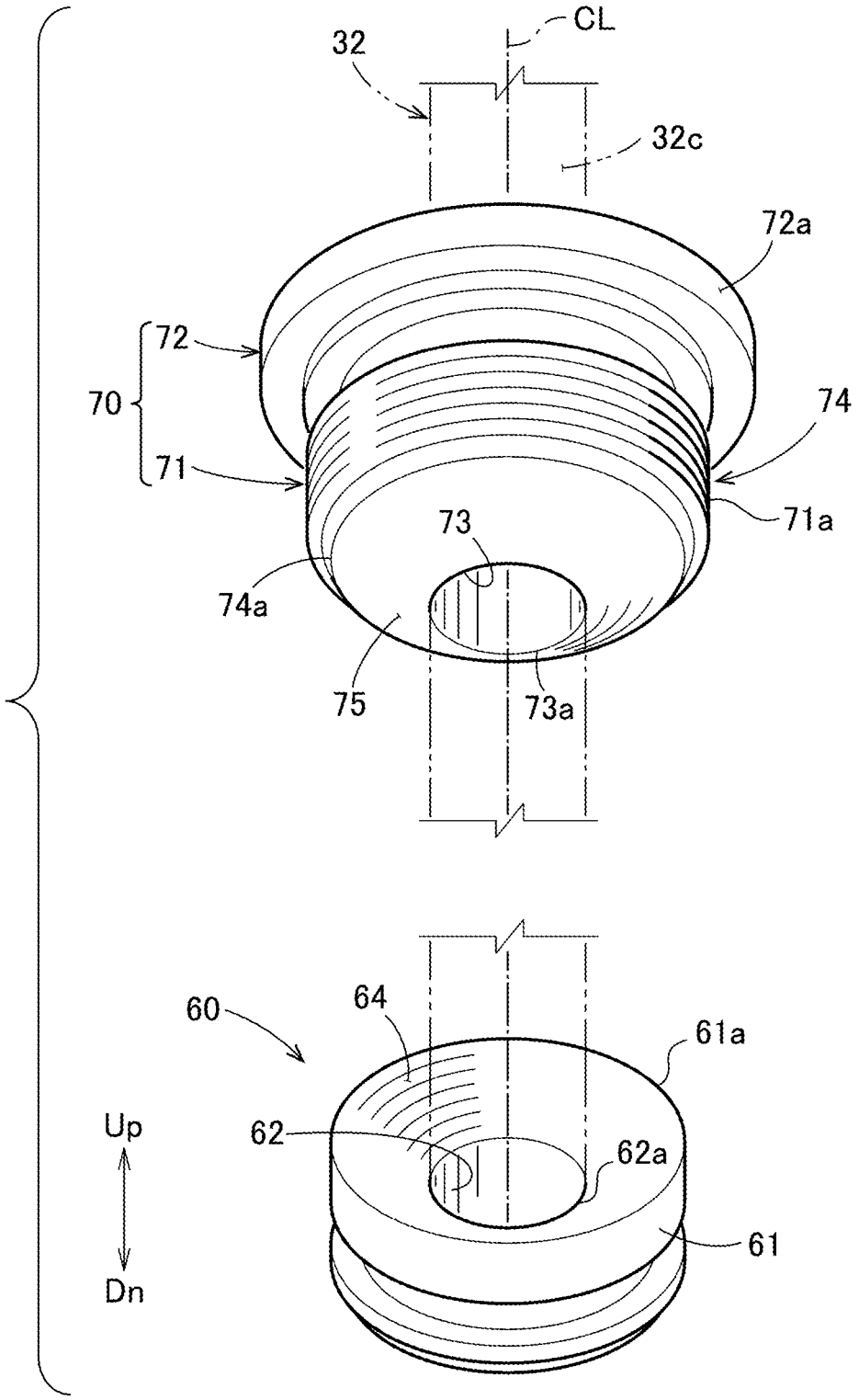
FIG. 5 is a perspective view showing a rod guide and a piston that are provided in the trim and tilt device according to the first embodiment.

In the trim and tilt device 20K, an upper end surface 38 of a trim cylinder 31K (an end surface at an opening side opposite to the bottom portion 35 (see FIG. 3)) is tilted in a manner in which a diameter of the upper end surface 38 is reduced as going toward the piston 60 side (lower side) (see FIG. 4). That is, in a cross section including the axis CL, an inner peripheral edge 38*a* of the upper end surface 38 is located closer to the piston side than an outer peripheral edge 38*b* of the upper end surface 38.

A rod guide 70K has a contact surface 78 that is in surface contact with the upper end surface 38 of the trim cylinder 31K over the entire periphery. The contact surface 78 connects the outer peripheral surface 71*a* of the small diameter portion 71 and the outer peripheral surface 72*a* of the large diameter portion 72.

Effects of the third embodiment will be described.

Even when a force in a direction intersecting the axial direction of the trim rod 32 is applied to the rod guide 70K and the rod guide 70K is slightly tilted relative to the trim cylinder 31K, the contact surface 78 of the rod guide 70K can maintain surface contact with the upper end surface 38 of the trim cylinder 31K. Therefore, rattling between the rod guide 70K and the trim cylinder 31K can be prevented. As a result, loosening of the rod guide 70K relative to the trim cylinder 31K can be prevented.

The present invention is not limited to the first to third embodiments as long as functions and effects of the present invention are exhibited. In the first to third embodiments, a configuration according to the present invention is applied to a trim cylinder device provided in a hydraulic cylinder device. Alternatively, the configuration of the present invention may be changed as appropriate and applied to a tilt cylinder device.

What is claimed is:

1. A trim and tilt device comprising:

a bottomed cylindrical cylinder that stores a fluid;

a piston that is slidable on an inner peripheral surface of the cylinder in an axial direction of the cylinder;

a rod that is a rod-shaped member, the rod including a first end to which the piston is fixed and a second end located at an opposite side to the first end in the axial direction and located outside the cylinder; and a rod guide that is fixed to the cylinder and slidably supports an outer peripheral surface of the rod in the axial direction, wherein over an entire periphery of the rod guide, a lower end of a first outer peripheral surface of the rod guide that is in contact with the inner peripheral surface of the cylinder is located closer to the second end than a lower end of a first inner peripheral surface of the rod guide where the outer peripheral surface of the rod is slidable, wherein the piston includes a second outer peripheral surface that is slidable on the inner peripheral surface of the cylinder and an insertion hole to which the first end of the rod is inserted, and wherein an upper end of the second outer peripheral surface is located closer to the second end than an upper end of the insertion hole.

2. The trim and tilt device according to claim 1, wherein the piston includes a second end surface that is an end surface facing toward the second end and has an annular shape, wherein the second end surface connects the second outer peripheral surface and the insertion hole, and wherein the second end surface is tilted relative to a radial direction of the cylinder in a cross section including an axis of the cylinder.

3. The trim and tilt device according to claim 2, wherein the second end surface has a groove that allows the fluid to flow.

4. The trim and tilt device according to claim 1, wherein the rod guide includes a first end surface that is an end surface facing toward the first end and has an annular shape, and the first end surface connects the first outer peripheral surface and the first inner peripheral surface, and wherein the first end surface is tilted relative to a radial direction of the cylinder in a cross section including an axis of the cylinder.

5. The trim and tilt device according to claim 4, wherein the first end surface has a groove that allows the fluid to flow.

6. The trim and tilt device according to claim 1, wherein an upper end surface of the cylinder is tilted in a manner in which a diameter of the upper end surface of the cylinder is reduced as going toward the piston, and wherein the rod guide has a contact surface that is in surface contact with the upper end surface of the cylinder over the entire periphery.

7. The trim and tilt device according to claim 2, wherein the rod guide includes a first end surface that is an end surface facing toward the first end and has an annular shape, and the first end surface connects the first outer peripheral surface and the first inner peripheral surface, and wherein the first end surface is tilted relative to the radial direction of the cylinder in the cross section including the axis of the cylinder.

8. The trim and tilt device according to claim 7, wherein the first end surface has a groove that allows the fluid to flow.

9. The trim and tilt device according to claim 2, wherein an upper end surface of the cylinder is tilted in a manner in which a diameter of the upper end surface of the cylinder is reduced as going toward the piston, and wherein the rod guide has a contact surface that is in surface contact with the upper end surface of the cylinder over the entire periphery.

10. The trim and tilt device according to claim 3, wherein the rod guide includes a first end surface that is an end surface facing toward the first end and has an annular shape, and the first end surface connects the first outer peripheral surface and the first inner peripheral surface, and wherein the first end surface is tilted relative to the radial direction of the cylinder in the cross section including the axis of the cylinder.

11. The trim and tilt device according to claim 10, wherein the first end surface has a groove that allows the fluid to flow.

12. The trim and tilt device according to claim 3, wherein an upper end surface of the cylinder is tilted in a manner in which a diameter of the upper end surface of the cylinder is reduced as going toward the piston, and wherein the rod guide has a contact surface that is in surface contact with the upper end surface of the cylinder over the entire periphery.

13. The trim and tilt device according to claim 4, wherein an upper end surface of the cylinder is tilted in a manner in which a diameter of the upper end surface of the cylinder is reduced as going toward the piston, and wherein the rod guide has a contact surface that is in surface contact with the upper end surface of the cylinder over the entire periphery.

14. The trim and tilt device according to claim 5, wherein an upper end surface of the cylinder is tilted in a manner in which a diameter of the upper end surface of the cylinder is reduced as going toward the piston, and wherein the rod guide has a contact surface that is in surface contact with the upper end surface of the cylinder over the entire periphery.

15. The trim and tilt device according to claim 7, wherein an upper end surface of the cylinder is tilted in a manner in which a diameter of the upper end surface of the cylinder is reduced as going toward the piston, and wherein the rod guide has a contact surface that is in surface contact with the upper end surface of the cylinder over the entire periphery.

16. The trim and tilt device according to claim 10, wherein an upper end surface of the cylinder is tilted in a manner in which a diameter of the upper end surface of the cylinder is reduced as going toward the piston, and wherein the rod guide has a contact surface that is in surface contact with the upper end surface of the cylinder over the entire periphery.

17. The trim and tilt device according to claim 8, wherein an upper end surface of the cylinder is tilted in a manner in which a diameter of the upper end surface of the cylinder is reduced as going toward the piston, and wherein the rod guide has a contact surface that is in surface contact with the upper end surface of the cylinder over the entire periphery.

18. The trim and tilt device according to claim 11, wherein an upper end surface of the cylinder is tilted in a manner in which a diameter of the upper end surface of the cylinder is reduced as going toward the piston, and wherein the rod guide has a contact surface that is in surface contact with the upper end surface of the cylinder over the entire periphery.

* * * * *